US009890785B2

(12) United States Patent
Tanaka et al.

(10) Patent No.: US 9,890,785 B2
(45) Date of Patent: Feb. 13, 2018

(54) ROTARY COMPRESSOR WITH SILICON DIOXIDE

(71) Applicant: FUJITSU GENERAL LIMITED, Kanagawa (JP)

(72) Inventors: Junya Tanaka, Kanagawa (JP); Kenji Komine, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 211 days.

(21) Appl. No.: 14/894,317

(22) PCT Filed: Jan. 29, 2014

(86) PCT No.: PCT/JP2014/051980

§ 371 (c)(1),
(2) Date: Nov. 25, 2015

(87) PCT Pub. No.: WO2015/045432

PCT Pub. Date: Apr. 2, 2015

(65) Prior Publication Data

US 2016/0131135 A1 May 12, 2016

(30) Foreign Application Priority Data

Sep. 30, 2013 (JP) ..... 2013-205824

(51) Int. Cl.
*F04C 18/356* (2006.01)
*F04C 29/02* (2006.01)
(Continued)

(52) U.S. Cl.
CPC ..... *F04C 18/3564* (2013.01); *F04C 23/008* (2013.01); *F04C 28/28* (2013.01);
(Continued)

(58) Field of Classification Search
CPC .. F04C 2280/02; F04C 29/02; F04C 18/3564; F04C 23/008; F04C 28/28; F04C 29/0085; F05C 2203/0886
See application file for complete search history.

(56) References Cited

U.S. PATENT DOCUMENTS 5,806,336 A 9/1998 Sunaga et al.

FOREIGN PATENT DOCUMENTS

BE 1012352 A3 10/2000
CN 101265909 A 9/2008
(Continued)

OTHER PUBLICATIONS

International Search Report dated Apr. 15, 2014, received in related International Application No. PCT/JP2014/051980, filed Jan. 29, 2014 (translation is provided).
(Continued)

*Primary Examiner* — Mary A Davis
(74) *Attorney, Agent, or Firm* — McDermott Will & Emery LLP

(57) ABSTRACT

A rotary compressor includes: a vertically-positioned air-tight compressor housing having an upper section including a discharge portion of a refrigerant, and a lower section including an inlet unit of the refrigerant and storing lubricant oil; a compressing unit, disposed in the lower section, compressing the refrigerant sucked in via the inlet unit and discharging the refrigerant from the discharge portion; a motor, disposed in the upper section, driving the compressing unit via a rotation shaft; and an accumulator attached to the compressor housing and connected to the inlet unit. Inside the accumulator and/or the compressor housing, silicon dioxide having a crystal structure containing a vacancy with a diameter equal to or less than a diameter of a water molecule or a composite including silicon dioxide having a crystal structure containing a vacancy with a diameter equal to or less than that of the water molecule is placed.

3 Claims, 2 Drawing Sheets

(51) Int. Cl.

| | |
|---|---|
| ***F04C 29/00*** | (2006.01) |
| ***F04C 28/28*** | (2006.01) |
| ***F04C 23/00*** | (2006.01) |

(52) U.S. Cl.

CPC ..... *F04C 29/0085* (2013.01); *F04C 29/02* (2013.01); *F04C 2280/02* (2013.01); *F05C 2203/0886* (2013.01)

(56) References Cited

FOREIGN PATENT DOCUMENTS

| | | | | | |
|---|---|---|---|---|---|
| CN | 103032331 | A | | 4/2013 | |
| JP | H05-106941 | A | | 4/1993 | |
| JP | H09-187646 | A | | 7/1997 | |
| JP | 2001-271774 | A | | 10/2001 | |
| JP | 2001271774 | A | * | 10/2001 | ..... F04C 18/3564 |
| JP | 2013-011226 | A | | 1/2013 | |

OTHER PUBLICATIONS

First Office Action dated Aug. 26, 2016, issued in corresponding Chinese Patent Application No. 201480031639.4 with English language translation.

Extended European Search Report dated Apr. 5, 2017 issued in European Patent Applicatoin No. 14849925.4.

R. E. Kauffman, "Determine the Mechanism for Copper Plating and Methods for its Elimination from HVAC Systems," ASHRAE Transactions, Jul. 1, 2008, pp. 360-374.

Australian Office Action dated Jan. 25, 2017 issued in Australian Patent Application No. 2014325843.

* cited by examiner

[FIG. 1]
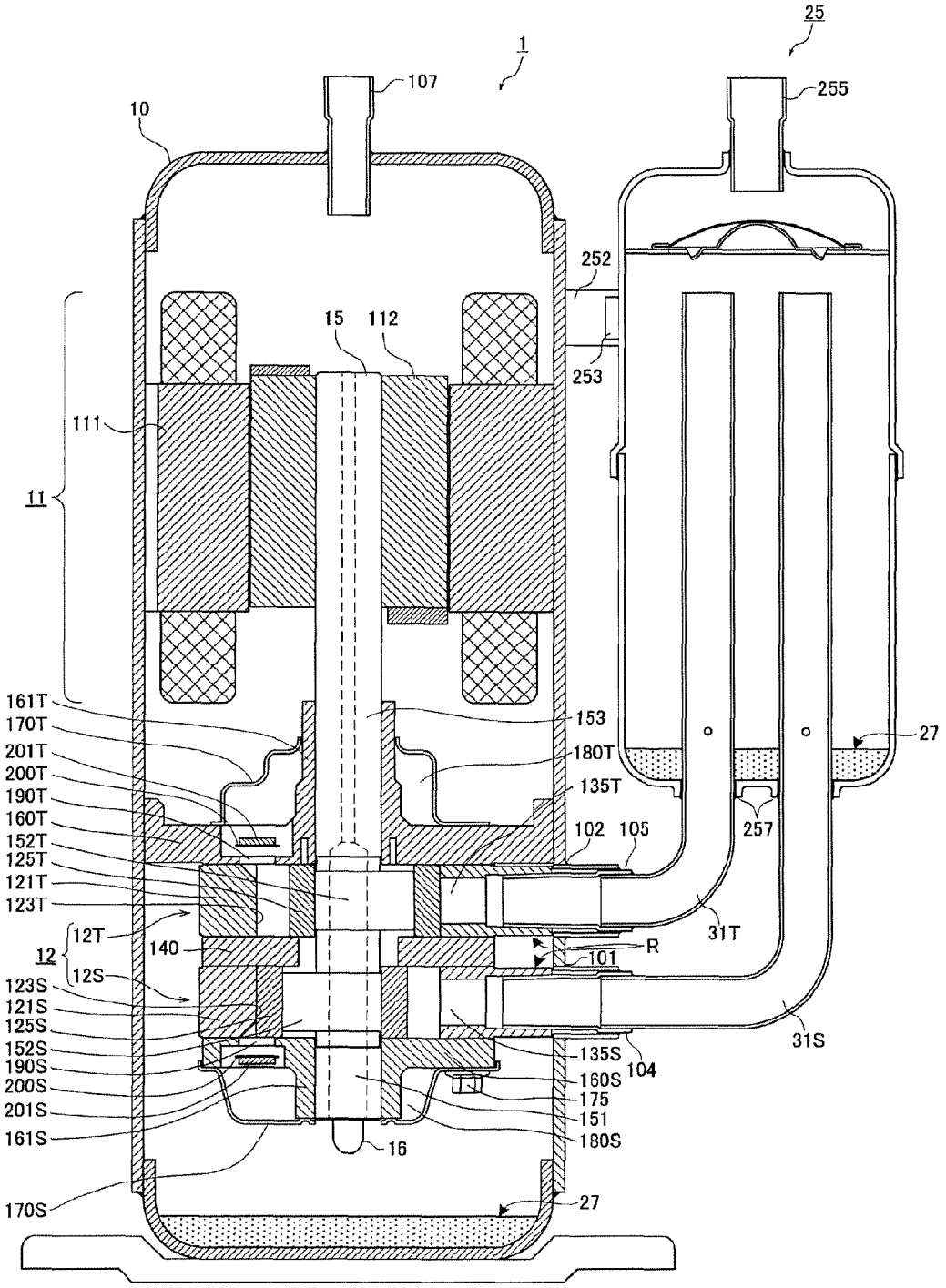

[FIG. 2]
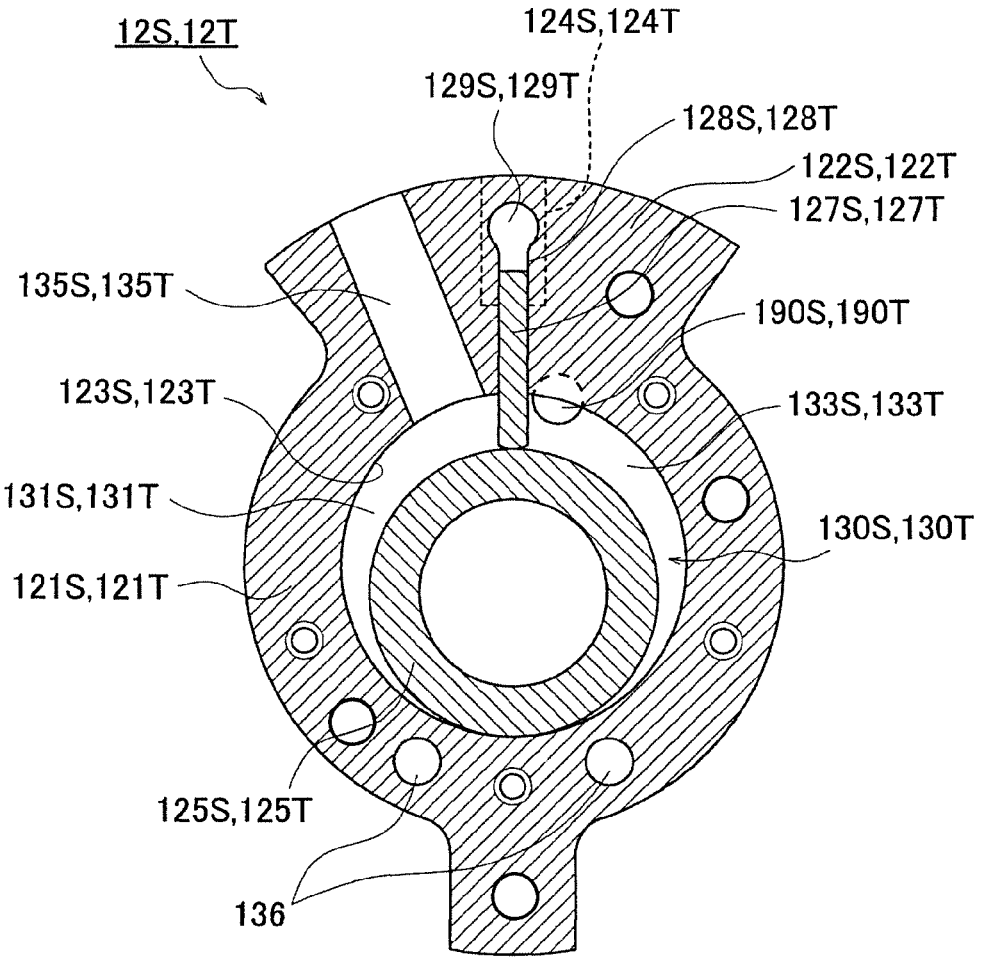

ROTARY COMPRESSOR WITH SILICON DIOXIDE

CROSS-REFERENCE

This application is the U.S. National Phase under 35 U.S.C. § 371 of International Application No. PCT/JP2014/051980, filed Jan. 29, 2014, which claims the benefit of Japanese Application No. 2013-205824, filed Sep. 30, 2013, the entire contents of each are hereby incorporated by reference.

TECHNICAL FIELD

The present invention relates to a rotary compressor that is used in an air conditioner or a refrigerating machine.

BACKGROUND ART

An acid material (carboxylic acid or the like produced due to degradation of lubricant oil or hydrochloric acid, hydrofluoric acid, or the like which is produced when halogen ions which are produced through chemical decomposition of molecules that make up a refrigerant react with water) inside refrigerant piping in an air conditioner, a refrigerating machine, or the like causes a copper surface of the refrigerant piping (copper piping) to become corroded and copper ions are eluted in the lubricant oil. The eluted copper ions are precipitated and adhered, in a plating manner, on a portion which becomes high in temperature, such as a sliding portion (which is made of steel or cast iron which has high ionization tendency with respect to copper) of a rotary compressor (copper plating phenomenon).

Progress of the copper plating phenomenon causes a gap in the sliding portion to become smaller and thus sliding friction of the rotary compressor to be increased. In addition, when the copper plating peels off, interposition of the copper plating on the sliding portion is caused and thus abnormal wear of the sliding portion may occur or an expansion valve or the like in a refrigerant circuit may become jammed.

In order to solve the above problems, in the related art, a refrigerating machine is disclosed, in which refrigerant is subjected to compression or expansion such that movement of heat is performed and the refrigerating machine is equipped with a zinc or zinc alloy component that removes infiltrated or produced copper ions in the refrigerant circuit (for example, see PTL 1).

CITATION LIST

Patent Literature

PTL 1: JP-A-5-106941

SUMMARY OF INVENTION

Technical Problem

However, according to a technology in the related art disclosed in PTL 1 above, the copper ions in the refrigerant react chemically with a surface of the zinc or zinc alloy component and then, copper is precipitated on the zinc surface. As a result, molten zinc reacts with the refrigerant (for example, R22 or R410A) and then, zinc halide (for example, zinc chloride) is produced. When a temperature of the surface of the zinc or zinc alloy component exceeds the dissolution temperature of the zinc chloride, the zinc chloride dissolves in the refrigerant circuit even though the dissolution of the zinc chloride depends on refrigerant temperature distribution in the refrigerant circuit. This results in problems in that adhesion of the zinc chloride occurs in the refrigerant circuit which has a refrigerant temperature lower than the dissolution temperature and the cycle is closed.

The present invention is performed by taking the above problems into account and has an object to achieve a rotary compressor in which copper ions in a refrigerant circuit can be removed without producing a reaction product such as zinc chloride.

Solution to Problem

In order to solve the above problems and to achieve the object, a rotary compressor of the present invention includes: a vertically-positioned airtight compressor housing having an upper section in which a discharge portion of a refrigerant is provided and a lower section in which an inlet unit of the refrigerant is provided and lubricant oil is stored; a compressing unit that is disposed in the lower section of the compressor housing and that compresses the refrigerant sucked in via the inlet unit and discharges the refrigerant from the discharge portion; a motor that is disposed in the upper section of the compressor housing and drives the compressing unit via a rotation shaft; and an accumulator that is attached to a side section of the compressor housing and is connected to the inlet unit of the refrigerant. Inside the accumulator and/or inside the compressor housing, silicon dioxide having a crystal structure which contains a vacancy with a diameter equal to or less than a diameter of a water molecule, or a composite which includes silicon dioxide having a crystal structure which contains a vacancy with a diameter equal to or less than the diameter of the water molecule is placed.

Advantageous Effects of Invention

According to the present invention, copper ions are subjected to physisorption into a vacancy with a diameter equal to or less than a diameter of a water molecule, in a crystal structure of silicon dioxide. Hence, the effects that a reaction product such as zinc chloride is not produced, a refrigerant circuit is not closed by the reaction product, and lubricant oil is not decomposed by the reaction product are achieved.

BRIEF DESCRIPTION OF DRAWINGS

FIG. 1 is a vertical cross-sectional view illustrating an example of a rotary compressor according to the present invention.

FIG. 2 is a horizontal cross-sectional view of first and second compressing units according to the example when viewed from above.

DESCRIPTION OF EMBODIMENTS

Hereinafter, an example of a rotary compressor according to the present invention will be described in detail based on the drawings. The invention is not limited to the example.

Example

FIG. 1 is a vertical cross-sectional view illustrating an example of a rotary compressor according to the present invention. FIG. 2 is a horizontal cross-sectional view of first and second compressing units according to the example when viewed from above.

As illustrated in FIG. 1, a rotary compressor 1 of the example includes a compressing unit 12 that is disposed in the lower section of a vertically-positioned airtight compressor housing 10 which has a cylindrical shape and a motor 11 that is disposed in the upper section of the compressor housing 10 and drives the compressing unit 12 via a rotation shaft 15.

A stator 111 of the motor 11 is formed in a cylindrical shape and is shrink-fitted and fixed in the inner circumferential surface of the compressor housing 10. A rotor 112 of the motor 11 is disposed inside the cylindrical stator 111 and is shrink-fitted and fixed to the rotation shaft 15 that mechanically connects the motor 11 with the compressing unit 12.

The compressing unit 12 includes a first compressing section 12S and a second compressing section 12T that is disposed in parallel with the first compressing section 12S and is stacked on the first compressing section 12S. As illustrated in FIG. 2, the first and second compressing units 12S and 12T include annular first and second cylinders 121S and 121T in which first and second inlet holes 135S and 135T that are radially disposed and first and second vane grooves 128S and 128T are provided in first and second side-flared portions 122S and 122T.

As illustrated in FIG. 2, circular first and second cylinder inner walls 123S and 123T are formed in the first and second cylinders 121S and 121T so as to be concentric with the rotation shaft 15 of the motor 11. First and second annular pistons 125S and 125T which have an outer diameter smaller than an inner diameter of the cylinder are provided inside the first and second cylinder inner walls 123S and 123T, respectively. First and second operation chambers 130S and 130T which suck in, compress, and discharge a refrigerant gas are formed between the first and second cylinder inner walls 123S and 123T and the first and second annular pistons 125S and 125T.

The first and second vane grooves 128S and 128T are formed over the entire cylinder height of the first and second cylinders 121S and 121T in a radial direction from the first and second cylinder inner walls 123S and 123T. First and second vanes 127S and 127T, each of which has a plate shape, are slidably fit in the first and second vane grooves 128S and 128T.

As illustrated in FIG. 2, first and second spring bores 124S and 124T are formed in a deep portion of the first and second vane grooves 128S and 128T such that communication from the outer circumferential portions of the first and second cylinders 121S and 121T to the first and second vane grooves 128S and 128T is performed. First and second vane springs (not illustrated) which press the back surface of the first and second vanes 127S and 127T are inserted into the first and second spring bores 124S and 124T.

When the rotary compressor 1 is started, the first and second vanes 127S and 127T protrude from the inside of the first and second vane grooves 128S and 128T to the inside of the first and second operation chambers 130S and 130T due to bounces of the first and second vane springs and ends of the vanes come into contact with the outer circumferential surfaces of the first and second annular pistons 125S and 125T. This allows the first and second vanes 127S and 127T to partition the first and second operation chambers 130S and 130T into first and second inlet chambers 131S and 131T and first and second compression chambers 133S and 133T.

In addition, the refrigerant gas compressed in the compressor housing 10 is guided into the first and second cylinders 121S and 121T by communicating the deep portion of the first and second vane grooves 128S and 128T with the inside of the compressor housing 10 via an opening R illustrated in FIG. 1. In this manner, First and second pressure guiding-in paths 129S and 129T which cause back pressures to be applied by the pressure of the refrigerant gas are formed in the first and second vanes 127S and 127T.

The first and second inlet holes 135S and 135T which cause the first and second inlet chambers 131S and 131T to communicate with the outside are provided in the first and second cylinders 121S and 121T such that a refrigerant is sucked into the first and second inlet chambers 131S and 131T from the outside.

In addition, as illustrated in FIG. 1, an intermediate partition plate 140 is disposed between the first cylinder 121S and the second cylinder 121T and partitions and closes the first operation chamber 130S (refer to FIG. 2) of the first cylinder 121S from the second operation chamber 130T (refer to FIG. 2) of the second cylinder 121T. A lower end plate 160S is disposed on a lower end portion of the first cylinder 121S and closes the first operation chamber 130S of the first cylinder 121S. In addition, an upper end plate 160T is disposed on an upper end portion of the second cylinder 121T and closes the second operation chamber 130T of the second cylinder 121T.

A sub-bearing unit 161S is formed on the lower end plate 160S and a sub-shaft unit 151 of the rotation shaft 15 is rotatably supported in the sub-bearing unit 161S. A main-bearing unit 161T is formed on the upper end plate 160T and a main-shaft unit 153 of the rotation shaft 15 is rotatably supported in the main-bearing unit 161T.

The rotation shaft 15 includes a first eccentric portion 152S and a second eccentric portion 152T which are eccentric by a 180° phase shift from each other. The first eccentric portion 152S is rotatably fit in the first annular piston 125S of the first compressing unit 12S. The second eccentric portion 152T is rotatably fit in the second annular piston 125T of the second compressing unit 12T.

When the rotation shaft 15 rotates, the first and second annular pistons 125S and 125T make orbital motions inside the first and second cylinders 121S and 121T along the first and second cylinder inner walls 123S and 123T in a counterclockwise direction in FIG. 2. Accordingly, the first and second vanes 127S and 127T perform reciprocal motions. The motions of the first and second annular pistons 125S and 125T and the first and second vanes 127S and 127T cause volumes of the first and second inlet chambers 131S and 131T and the first and second compression chambers 133S and 133T to be continually changed. In this manner, the compressing unit 12 continually sucks in, compresses, and discharges the refrigerant gas.

As illustrated in FIG. 1, a lower muffler cover 170S is disposed on the lower side of the lower end plate 160S and a lower muffler chamber 180S is formed between the lower end plate 160S and the lower muffler cover 170S. The first compressing unit 12S opens to the lower muffler chamber 180S. That is, a first outlet 190S (refer to FIG. 2) through which the first compression chamber 133S of the first cylinder 121S communicates with the lower muffler chamber 180S is provided in the vicinity of the first vane 127S of the lower end plate 160S. In addition, a first discharge valve 200S which prevents the compressed refrigerant gas from flowing backward is disposed in the first outlet 190S.

The lower muffler chamber 180S is a single annular chamber. The lower muffler chamber 180S is a part of a communication path through which a discharge side of the first compressing unit 12S communicates with the inside of the upper muffler chamber 180T by passing through a refrigerant path 136 (refer to FIG. 2) which penetrates the lower end plate 160S, the first cylinder 121S, the intermediate partition plate 140, the second cylinder 121T and the upper end plate 160T. The lower muffler chamber 180S causes pressure pulsation of the discharged refrigerant gas to be reduced. In addition, a first discharge valve cover 201S which controls an amount of flexural valve opening of the first discharge valve 200S is stacked on the first discharge valve 200S and is fixed to the first discharge valve 200S using a rivet. The first outlet 190S, the first discharge valve 200S, and the first discharge valve cover 201S configure a first discharge valve unit of the lower end plate 160S.

As illustrated in FIG. 1, an upper muffler cover 170T is disposed on the upper side of the upper end plate 160T and an upper muffler chamber 180T is formed between the upper end plate 160T and the upper muffler cover 170T. A second outlet 190T (refer to FIG. 2) through which the second compression chamber 133T of the second cylinder 121T communicates with the upper muffler chamber 180T is provided in the vicinity of the second vane 127T of the upper end plate 160T. A reed valve type second discharge valve 200T which prevents the compressed refrigerant gas from flowing backward is disposed in the second outlet 190T. In addition, a second discharge valve cover 201T which controls an amount of flexural valve opening of the second discharge valve 200T is stacked on the second discharge valve 200T and is fixed using a rivet with the second discharge valve 200T. The upper muffler chamber 180T causes pressure pulsation of discharged refrigerant to be reduced. The second outlet 190T, the second discharge valve 200T, and the second discharge valve cover 201T configure a second discharge valve unit of the upper end plate 160T.

The first cylinder 121S, the lower end plate 160S, the lower muffler cover 170S, the second cylinder 121T, the upper end plate 160T, the upper muffler cover 170T, and the intermediate partition plate 140 are integrally fastened using a plurality of penetrating bolts 175 or the like. The outer circumferential portion of the upper end plate 160T of the compressing unit 12 which is integrally fastened using the penetrating bolts 175 or the like is firmly fixed to the compressor housing 10 through spot welding such that the compressing unit 12 is fixed to the compressor housing 10.

First and second through holes 101 and 102 are provided in the outer-side wall of the cylindrical compressor housing 10 at an interval in an axial direction in this order from a lower section thereof so as to communicate with first and second inlet pipes 104 and 105, respectively. In addition, outside the compressor housing 10, an accumulator 25 which is formed of a separate airtight cylindrical container is held by an accumulator holder 252 and an accumulator band 253.

A system connecting pipe 255 which is connected to an evaporator in a refrigeration cycle is connected at the center of the top portion of the accumulator 25. First and second low-pressure communication tubes 31S and 31T, each of which has one end extending toward the upward side inside the accumulator 25, and which have the other ends connected to the other end of each of the first and second inlet pipes 104 and 105, are connected to a bottom through hole 257 provided in the bottom of the accumulator 25.

The first and second low-pressure communication tubes 31S and 31T which guide a low pressure refrigerant in the refrigeration cycle to the first and second compressing units 12S and 12T via the accumulator 25 are connected to the first and second inlet holes 135S and 135T (refer to FIG. 2) of the first and second cylinders 121S and 121T via the first and second inlet pipes 104 and 105 as an inlet unit. That is, the first and second inlet holes 135S and 135T are connected to the evaporator of the refrigeration cycle in parallel.

A discharge pipe 107 as a discharge portion which is connected to the refrigeration cycle and discharges a high pressure refrigerant gas to a side of a condenser in the refrigeration cycle is connected to the top portion of the compressor housing 10. That is, the first and second outlets 190S and 190T are connected to the condenser in the refrigeration cycle.

Lubricant oil is sealed in the compressor housing 10 substantially to the elevation of the second cylinder 121T. In addition, the lubricant oil is sucked up from a lubricating pipe 16 attached to the lower end portion of the rotation shaft 15, using a pump blade (not illustrated) which is inserted into the lower section of the rotation shaft 15. The lubricant oil circulates through the compressing unit 12, sliding components are lubricated, and the lubricant oil seals a fine gap in the compressing unit 12.

Next, a characteristic configuration of the rotary compressor of the example will be described with reference to FIG. 1. As illustrated in FIG. 1, on the bottom of the accumulator 25, silicon dioxide (silica) 27 having a crystal structure which contains a vacancy (for example, a diameter is 0.3 nm) with a diameter equal to or less than a diameter (0.38 nm) of a water molecule, or a composite that includes silicon dioxide having a crystal structure which contains a vacancy with a diameter equal to or less than the diameter of the water molecule is placed. The silicon dioxide 27 having the crystal structure which contains the vacancy with the diameter equal to or less than the diameter of the water molecule, or the composite 27 that includes the silicon dioxide having the crystal structure which contains the vacancy with the diameter equal to or less than the diameter of the water molecule may be placed inside the compressor housing 10. In addition, the silicon dioxide 27 having the crystal structure which contains the vacancy with the diameter equal to or less than the diameter of the water molecule or the composite 27 that includes the silicon dioxide having the crystal structure which contains the vacancy with the diameter equal to or less than the diameter of the water molecule may be placed both inside the accumulator 25 and inside the compressor housing 10.

Further, the silicon dioxide 27 having the crystal structure which contains the vacancy with the diameter equal to or less than the diameter of the water molecule, or the composite 27 that includes the silicon dioxide having the crystal structure which contains the vacancy with the diameter equal to or less than the diameter of the water molecule may be placed on and may coat an inner wall surface of the accumulator 25 and/or an inner wall surface of the compressor housing 10.

It is known that eluted copper ions become trapped (adsorbed) into the silicon dioxide. However, the surface contact area acquired only by the silicon dioxide is small and thus, the effect of trapping the copper ions is small. Therefore, the composite 27 that includes the silicon dioxide is placed inside the accumulator 25 and/or inside the compressor housing 10. This causes the eluted copper ions in the lubricant oil to be trapped and thus, it is possible to prevent the sliding portion of the compressing unit 12 from being plated with copper.

Crystalline synthetic zeolites {trade name: molecular sieve: general formula=$M_{2/n}O.Al_2O_3.xSiO_2.yH_2O$ (M: metallic cation and n: valence)} which are used as a desiccant that removes water in the refrigeration cycle include the silicon dioxide. However, the synthetic zeolites are the desiccant and thus have large vacancies that are suitable for trapping water. Therefore, when a great amount of water is present in the refrigeration cycle, water is trapped before the copper ions are trapped and it is not possible for the synthetic zeolites to achieve an effect of sufficiently preventing copper plating.

The diameter of the water molecule is about 0.38 nm and a molecular diameter of a copper ion is about 0.128 nm. Therefore, the size (diameter) of the vacancy of the composite 27 including the silicon dioxide is set to a size (for example, 0.3 nm or less) so that water is not trapped. In this manner, it is possible for only the copper ions to be trapped in the vacancy and it is possible to prevent the sliding portion of the compressing unit 12 from being plated with copper.

Particularly, when the silicon dioxide 27 having the crystal structure which contains a vacancy of 0.3 nm or less, or the composite 27 that includes the silicon dioxide having the crystal structure which contains a vacancy of 0.3 nm or less is placed inside the accumulator 25, it is possible to trap copper ions in the refrigerant which has not yet flowed into the compressing unit 12 of the rotary compressor 1 and it is highly effective to prevent the copper plating.

REFERENCE SIGNS LIST

1 rotary compressor
10 compressor housing
11 motor
12 compressing unit
15 rotation shaft
16 lubricating pipe
25 accumulator
27 silicon dioxide having a crystal structure which contains a vacancy of 0.3 nm or less or a composite which includes silicon dioxide having a crystal structure which contains a vacancy of 0.3 nm or less
31S first low-pressure communication tube
31T second low-pressure communication tube
101 first through hole
102 second through hole
104 first inlet pipe (inlet unit)
105 second inlet pipe (inlet unit)
107 discharge pipe (discharge portion)
111 stator
112 rotor
12S first compressing unit
12T second compressing unit
121S first cylinder (cylinder)
121T second cylinder (cylinder)
122S first side-flared portion
122T second side-flared portion
123S first cylinder inner wall (cylinder inner wall)
123T second cylinder inner wall (cylinder inner wall)
124S first spring bore
124T second spring bore
125S first annular piston (annular piston)
125T second annular piston (annular piston)
127S first vane (vane)
127T second vane (vane)
128S first vane groove (vane groove)
128T second vane groove (vane groove)
129S first pressure guiding-in path
129T second pressure guiding-in path
130S first operation chamber (operation chamber)
130T second operation chamber (operation chamber)
131S first inlet chamber (inlet chamber)
131T second inlet chamber (inlet chamber)
133S first compression chamber (compression chamber)
133T second compression chamber (compression chamber)
135S first inlet hole (inlet hole)
135T second inlet hole (inlet hole)
136 refrigerant path
140 intermediate partition plate
151 sub-shaft unit
152S first eccentric portion (eccentric portion)
152T second eccentric portion (eccentric portion)
153 main-shaft unit
160S lower end plate (end plate)
160T upper end plate (end plate)
161S sub-bearing unit
161T main-bearing unit
170S lower muffler cover
170T upper muffler cover
175 penetrating bolt
180S lower muffler chamber
180T upper muffler chamber
190S first outlet (outlet)
190T second outlet (outlet)
200S first discharge valve
200T second discharge valve
201S first discharge valve cover
201T second discharge valve cover
252 accumulator holder
253 accumulator band
255 system connecting pipe
R opening

The invention claimed is:

1. A rotary compressor comprising:

a vertically-positioned airtight compressor housing having an upper section in which a discharge portion of a refrigerant is provided and a lower section in which an inlet unit of the refrigerant is provided and lubricant oil is stored;

a compressing unit that is disposed in the lower section of the compressor housing and that compresses the refrigerant sucked in via the inlet unit and discharges the refrigerant from the discharge portion;

a motor that is disposed in the upper section of the compressor housing and drives the compressing unit via a rotation shaft; and an accumulator that is attached to a side section of the compressor housing and is connected to the inlet unit of the refrigerant, wherein copper ions are eluted from a refrigerant piping into the lubricant oil in the rotary compressor, and placed inside the accumulator and/or inside the compressor housing is, silicon dioxide having a crystal structure which contains a vacancy into which the copper ions become trapped, the vacancy having a diameter equal to or greater than a diameter of the copper ions and a diameter equal to or less than a diameter of a water molecule, or a composite which includes silicon dioxide having a crystal structure which contains a vacancy into which the copper ions become trapped, the vacancy having a diameter equal to or greater than a diameter of the copper ions and a diameter equal to or less than the diameter of the water molecule.

2. The rotary compressor according to claim 1, wherein the diameter of the vacancy is 0.128 nm or greater and is 0.3 nm or less.

3. The rotary compressor according to claim 1, wherein coated and placed on an accumulator inner wall surface and/or a compressor housing inner wall surface is:

the silicon dioxide having the crystal structure which contains the vacancy into which the copper ions become trapped, the vacancy having a diameter equal to or greater than a diameter of the copper ions and a diameter equal to or less than the diameter of the water molecule, or the composite which includes the silicon dioxide having the crystal structure which contains the vacancy into which the copper ions become trapped, the vacancy having a diameter equal to or greater than a diameter of the copper ions and a diameter equal to or less than the diameter of the water molecule.

* * * * *